United States Patent [19]

Hoke

[11] Patent Number: 4,747,634

[45] Date of Patent: May 31, 1988

[54] APPARATUS FOR SUSPENDING A LIFTING PAD

[76] Inventor: Thomas A. Hoke, R.D. #2, Red Lion, Pa. 17356

[21] Appl. No.: 943,102

[22] Filed: Dec. 18, 1986

[51] Int. Cl.[4] ..... B66C 1/02

[52] U.S. Cl. ..... 294/64.1; 248/610; 267/169; 267/179

[58] Field of Search ..... 294/64.1, 65, 65.5, 294/81.1, 81.5, 81.56, 81.6, 82.16; 248/363, 573, 601, 610; 267/73, 74, 169, 170, 174, 178, 179; 414/627, 737, 744 B, 752

[56] References Cited

U.S. PATENT DOCUMENTS

| | | | |
|---|---|---|---|
| 1,228,690 | 6/1917 | Monnet | 294/65 |
| 1,285,657 | 11/1918 | Finucan | 248/610 X |
| 4,266,905 | 5/1981 | Birk et al. | 294/64.1 X |

FOREIGN PATENT DOCUMENTS

| | | | |
|---|---|---|---|
| 2243760 | 3/1974 | Fed. Rep. of Germany | 294/64.1 |
| 2529431 | 1/1977 | Fed. Rep. of Germany | 294/65 |
| 1480383 | 5/1967 | France | 294/81.5 |
| 791584 | 12/1980 | U.S.S.R. | 294/65 |
| 1025639 | 6/1983 | U.S.S.R. | 294/64.1 |

*Primary Examiner*—Johnny D. Cherry
*Attorney, Agent, or Firm*—Charles J. Long

[57] ABSTRACT

A lifting pad is suspended from a traversing member mounted on and movable along a generally horizontal beam. The pad is suspended by a single generally vertical coil spring having predetermined tensile load versus extension characteristics. In order to prevent this spring from extending beyond a predetermined length corresponding to a predetermined design load, the apparatus includes a lanyard having a flexible lower portion with a loop at the lower end and a rigid upper portion threaded at its upper end. At loads above the design load a self-locking nut threaded on the upper end of the lanyard abuts a horizontal surface of the traversing member and the loop at the lanyard's lower end engages a horizontal pin mounted on the lifting pad, whereby the portion of the load in excess of the design load is borne by the lanyard and further extension of the spring is prevented.

3 Claims, 1 Drawing Sheet

APPARATUS FOR SUSPENDING A LIFTING PAD

BACKGROUND OF THE INVENTION

1. Field of the Invention

This invention relates to lifting devices of the type in which a lifting pad is suspended from a beam. More particularly, the invention relates to apparatus for suspending a lifting pad from a generally horizontal beam.

2. Description of Related Art

In lifting flat articles such as flexible sheets and plates for movement from one location to another, it is common to use an arrangement in which one or more lifting pads are suspended from a horizontal beam, the horizontal beam in turn being suspended by a crane or similar arrangement. Where the articles are made of magnetic material, such pads may be electromagnets with a flat lower surface. Where the articles are non-magnetic or have a surface susceptible to damage from contact with an electromagnet, it is common to utilize a vacuum lifting pad, normally comprising a resilient ring which engages the surface and adheres thereto upon creation of a vacuum in the space surrounded by the ring.

Heretofore, lifting pads of the type described have been suspended from beams by lengths of chain or ball bolt arrangements, the latter comprising an elongated bolt having a ball at its lower end which is held in place by a socket formed in an upstanding boss attached to the top surface of the lifting pad; some ball bolt suspension arrangements are shown in the following listed U.S. Pat. Nos.: 3,152,828 (FIGS. 2 & 3); 3,183,032 (FIG. 2); 3,785,691 (FIG. 3); and 3,910,620 (FIG. 2).

Chain is sometimes satisfactory for suspending electromagnetic lifting pads, but having no compressive column strength it is generally unsatisfactory for vacuum lifting pads, which must often be pushed downward slightly on to the surface of the article being lifted so as to form a ring-to surface seal which will sustain the vacuum.

The ball bolt arrangement has sufficient column strength for vacuum lifting, but articulation or tilting of a lifting pad suspended by such an arrangement is typically limited to a maximum of about 7° from the horizontal; when vacuum lifting a flexible or wavy sheet, especially a large sheet which requires two or more spaced lifting pads, loss of vacuum can occur if the sheet bends or has surface waviness to a degree which tilts the lifting pad past the limit imposed by the ball bolt arrangement.

I have developed suspension apparatus for a lifting pad which has sufficient column strength to be useful for vacuum lifting systems, allows the lifting pad to articulate or tilt up to 30° or more from the horizontal, and includes secondary means for preventing unwanted distortion of the primary suspension component when the load on the lifting pad exceeds a predetermined level.

SUMMARY OF THE INVENTION

In accordance with the invention, I provide apparatus for suspending a lifting pad below a generally horizontal beam, comprising a single coil spring oriented with its longitudinal axis generally vertical and having predetermined tensile load versus extension characteristics; means securing the lower end of the coil spring to the lifting pad and the upper end of the coil spring to the beam; and means preventing extension of the coil spring beyond a predetermined length when the lifting pad is under load conditions.

In a preferred embodiment, the means securing the lower end of the coil spring to the lifting pad comprise an upstanding boss attached to the upper face of the lifting pad, the means securing the upper end of the coil spring to the beam comprise a traversing member movable along the longitudinal axis of the beam and having a lower surface from which a boss depends, the upstanding boss and the depending boss being threaded conformably to the size and pitch of the coil spring, the lower and upper ends of the coil spring being threaded to the upstanding and depending bosses respectively, the apparatus including means to secure the ends of the coil spring in their threaded positions on the upstanding and depending bosses.

In an especially preferred embodiment, the means preventing extension of the coil spring comprise a generally horizontal pin mounted on the lifting pad and intersecting the longitudinal axis of the coil spring; a generally vertically elongated lanyard member including a flexible lower portion having a loop at its lower end, the lanyard member being positioned within and generally coaxially with the coil spring, the loop encircling the horizontal pin; and support means at the upper end of the lanyard member for preventing vertical downward movement of the lanyard member past a predetermined position which is so related to the length of the lanyard member that when the coil spring is extended to the predetermined length the loop engages the horizontal pin and the upper end is supported by the support means, whereby the lifting pad is supported by the lanyard member and further extension of the coil spring is prevented.

BRIEF DESCRIPTION OF THE DRAWINGS

In the accompanying drawings I have shown a present preferred embodiment of the invention in which.

DESCRIPTION OF THE PREFERRED EMBODIMENT

Figure 2:
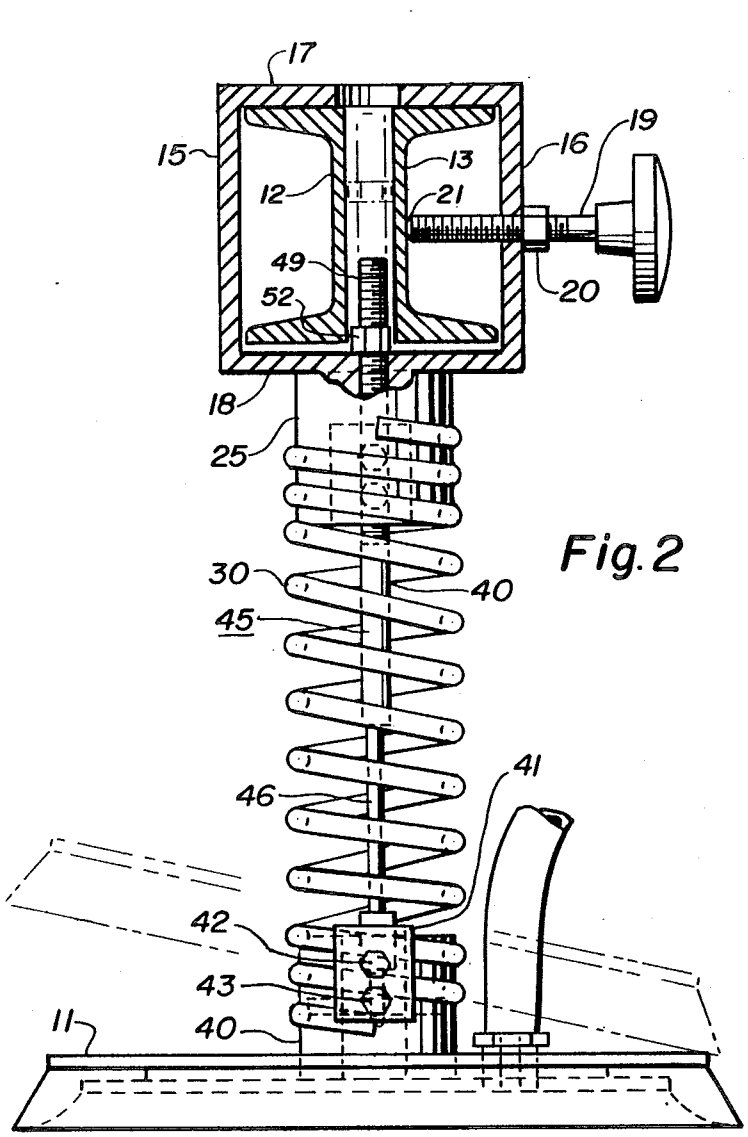
FIG. 2 is a view taken along line 2—2 of FIG. 1 and partly in section, showing the apparatus of FIG. 1 in the partially overloaded condition with the extension-limiting means in engagement.

Referring to the drawing figures, there is shown a generally horizontal beam 10 from which is suspended a lifting pad 11, in this case a vacuum lifing pad of generally common design. Beam 10 is formed from two parallel spaced apart outwardly facing channels 12 and 13 joined at each end by being welded to a plate, not shown. Beams fabricated differently can of course be used, but for the embodiment shown in the figure the beam must have a central gap extending vertically through the beam as shown in FIG. 2. A traversing member 14 is moveable longitudinally along beam 10; member 14 is hollow, having side walls 15 and 16 and top and bottom walls 17 and 18 respectively, all formed from steel plate. The interior of member 14 fits closely around beam 10 but is slideable along the beam. Traversing member 14 is frictionally held in any desired position along the beam by means of a bolt 19 with a knob at one end, the bolt being threaded through a nut 20 welded to the side wall 16 of member 14 and a hole formed in side wall 16. Tightening bolt 19 forces its end 21 against the web of channel 13 to thereby hold member 14 in place.

A depending cylindrical boss 25 is attached to the center of bottom wall 18 of member 14. The exterior surface of boss 25 is grooved in a thread pattern which accommodates several turns of the top end of a coil spring 30 having its longitudinal axis generally vertical. After coil spring 30 is threaded on to boss 25 it is fixed in place by a keeper plate 31 held against the spring turns by bolts 32 and 33 threaded into holes in boss 25.

An upstanding cylindrical boss 40 attached to the center of the top surface of vacuum pad 11 has its exterior surface grooved in a thread pattern matching the pattern on boss 25. Several turns of the bottom end of spring 30 are threaded on to boss 40 and fixed in place by a keeper plate 41 held against the spring by bolts 42 and 43. In order to further insure against turns of spring 30 slipping out of the grooves in bosses 25 and 40 under tensile load, the grooves are preferably cut to a generally semi-circular cross sectional shape having a radius approximately equal to the radius of the wire from which spring 30 is formed, thereby accommodating about ½ the depth of the spring wire.

Spring 30 is formed from material and in dimensions providing predetermined tensile load versus extension characteristics suitable to allow lifting of a predetermined design load without extending the spring beyond a predetermined length within the elastic limit of the material from which the spring is made.

I prefer that spring 30 be long enough to allow for five to ten turns to be unrestrained by the grooves in bosses 25 and 40 or by keeper plates 31 or 41. The spring shown in FIGS. 1 and 2 has 7½ such unrestrained turns.

As thus far described, the preferred embodiment of suspension apparatus according to the invention allows lifting pad 11 to articulate or tilt up to 30° or more from the horizontal; FIG. 2 shows pad 11 in broken lines tilted about 15° from the horizontal. Although not shown in FIG. 2, it will be appreciated that tilting of pad 11 causes spring 30 to deflect laterally in the direction of tilting.

As long as the load on pad 11 does not exceed the design load mentioned above, suspension apparatus comprising only spring 30 would function satisfactorily. However, in actual use the design load will occasionally and sometimes frequently be exceeded, often unintentionally, so apparatus according to the invention further includes means preventing extension of spring 11 beyond the pre-determined length corresponding to the design load. My extension limiting means allows loads greater than the design load to be lifted without permanent damage to the spring, in the event such loads are encountered.

A generally vertical lanyard 45, comprising a flexible lower portion 46 having a loop 47 at the bottom and a rigid upper portion 48 having a threaded upper end 49, is positioned coaxially with spring 30. The loop 47 encircles a horizontal pin 50 fixed in a vertical hole in boss 40. The upper end 49 extends upwardly through aligned holes formed in boss 25 and the bottom wall 18 of mexber 14 and into the central gap between channels 12 and 13. The central gap and a hole formed in top wall 17 of member 14 are sized to freely allow the passage of a self-locking nut 52 which is larger in diameter than the hole in bottom wall 18 of member 14. Nut 52 is threaded on to the upper end 49 of lanyard 45 to a predetermined point where, when spring 30 is extended to its predetermined design load length, loop 47 engages pin 50 and nut 52 abuts the inner surface of the bottom wall 18 of member 14, whereby at loads above the design load vertical downward movement of lanyard 45 below the predetermined position fixed by nut 57 is prevented and lifting pad 11 is supported by lanyard 45 so that further extension of spring 30 is prevented.

Figure 1:
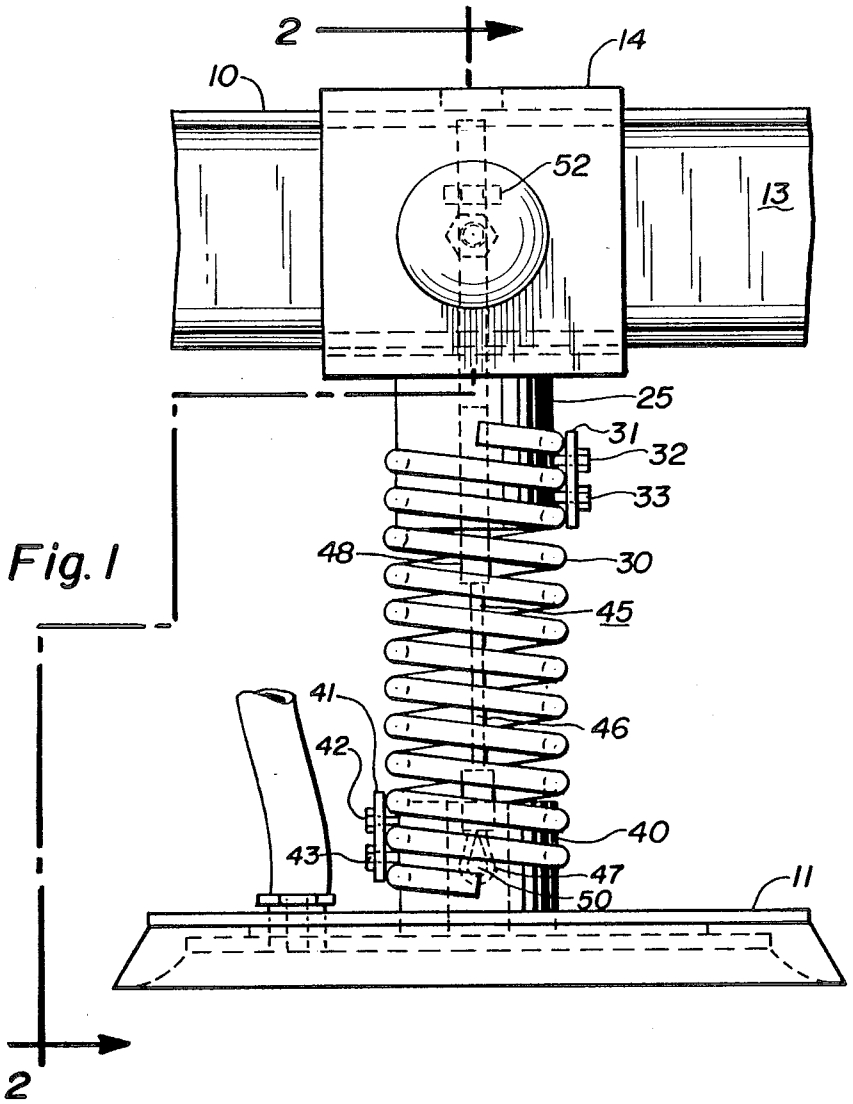
FIG. 1 is a side view of apparatus according to the invention in an unloaded condition.

FIG. 1 shows the preferred embodiment of the invention in unloaded condition; spring 30 is in a rest or a non-extended configuration and nut 52 is well above bottom wall 18 of member 14, i.e., lanyard 45 is free to move up or down. FIG. 2 shows the invention in the partially overloaded condition—i.e., supporting a load greater than the design load; in this case spring 30 is extended to the predetermined maximum or design load length and lanyard 45 is supporting the load through engagement of loop 47 with pin 50 and abutment of nut 52 against the internal surface of bottom wall 18 of member 14.

Apparatus according to the invention can be designed for various load capacities and from various materials; specific capacities and material selections are considered to be within the knowledge or choice of those skilled in engineering and material science. A version of the embodiment shown in FIGS. 1 and 2 with a design load of 700 pounds and a maximum load of 4,000 pounds, has the following listed major specifications:

Horizontal Beam 10: Steel; height of channels (12 and 13) 4"; web thickness 3/16"; flange width 1⅝"; gap between channels ⅞".

Traversing Member 14: Steel; length 2½"; height 5"; width 5 1/16"; wall thickness ⅜"; internal width 4¼", internal height 4⅛"; hole in top wall 1" diam.; hole in bottom wall ½" diam.

Depending Boss 25: Steel; 2⅝" diam., 2½" height; central vertical hole ½" diam.; exterior surface grooved from bottom to accommodate 2¼ turns of spring 30; groove cross section is semi-circular, 3/16" radius.

Upstanding Boss 40: Steel; 2⅝" diam., 2½" height; central vertical hole 1" diam.; exterior surface grooved from top as in boss 25.

Horizontal Pin 50: Steel, 7/16" diam. by 2¼" long, one end friction fitted in horizontal hole through one wall of boss 40, other end friction fitted in horizontal hole in opposite wall of boss.

Spring 30: Formed from ⅜" diam. steel wire; 3" outside diameter; 2¼" inside diameter; 12 coils and 8" length as formed; 2¼ coils at top threaded on to boss 25, 2¼ coils at bottom threaded on to boss 40; no-load unrestrained length 4¾"; axial tensile load versus extension, 233 pounds per inch; total extension at 700 pounds design load, 3".

Lanyard 45: Capacity 4,000 pounds; overall length 13⅜"; rigid upper portion length 7⅜", ⅜" diam. steel rod, top 3" threaded; flexible lower portion 3/16" diam. wire rope with 2" at top swaged into hole in upper portion, 2" long loop formed at lower end by bending end 180° and restrained by swaged fitting; maximum interior width of loop ½", maximum exterior width of loop ¾".

Nut 52: "Nylock" steel hex nut, ¾" O.D.

With the above specifications, loads up to 700 pounds can be lifted using the spring alone. However, in the event loads greater than 700 pounds must be lifted, the lanyard allows up to 4,000 pounds to be lifted by the vacuum pad and, because of its flexible lower end, still allows the pad to tilt up to 30° or more from the horizontal.

While I have shown and described a present preferred embodiment of the invention, it is to be distinctly understood that the invention is not limited thereto but may be otherwise variously embodied within the scope of the following claims.

I claim:

1. An arrangement for lifting flat articles of the type in which a lifting pad is suspended below a generally horizontal beam, the beam in turn being suspended from a crane or other source of lifting power, the pad adhering to the flat article during the lifting operation, wherein the improvement comprises apparatus for suspending the lifting pad from the horizontal beam, comprising:

(a) a single coil spring oriented with its longitudinal axis generally vertical and having predetermined tensile load versus extension characteristics, the coil spring having lower and upper end portions secured respectively to the lifting pad and the beam by securing means adapted to retain the end portions in place when the coil spring is under tensile load, the length of the coil spring being such as to allow from five to ten unrestrained turns or coils thereof between the end portions which are secured by the securing means; and (b) overload support means operative at tensile loads above a predetermined design load to support the portion of said loads in excess of the design load and to prevent extension of the coil spring beyond a predetermined length corresponding to the design load, said means being so constructed and arranged that at loads equal to or less than the design load they do not restrain movement of the coil spring.

2. Apparatus as claimed in claim 1 in which (a) the means securing the lower end of the coil spring to the lifting pad comprise an upstanding boss attached to an upper face of the lifting pad;

(b) the means securing the upper end of the coil spring to the beam comprise a traversing member movable along the longitudinal axis of the beam and having a lower surface from which a boss depends;

(c) the upstanding boss of (a) and the depending boss of (b) are threaded conformably to the size and pitch of the coil spring;

(d) the lower and upper ends of the coil spring are threaded on to the upstanding and depending bosses respectively; and (e) the apparatus includes means to secure the ends of the coil spring in their threaded positions on the upstanding and depending bosses.

3. Apparatus as claimed in claims 1 or 2, in which the overload support means comprise (a) a generally horizontal pin mounted on the lifting pad and intersecting the longitudinal axis of the coil spring;

(b) a generally vertical elongated lanyard member including an upper end and a flexible lower portion having a loop at its lower end, the lanyard member being positioned within and generally coaxially with the coil spring, the loop encircling the horizontal pin; and (c) means for preventing vertical downward movement of the lanyard member past a predetermined position, said means engaging and supporting the upper end of the lanyard member whenever the predetermined position is reached, the predetermined position being so related to the length of the lanyard member that when the coil spring is extended to the predetermined length, the loop engages the horizontal pin, whereby further extension of the coil spring is prevented.

* * * * *